US008042224B2

(12) United States Patent
White et al.

(10) Patent No.: US 8,042,224 B2
(45) Date of Patent: Oct. 25, 2011

(54) CLEANING APPLIANCE

(75) Inventors: William Robert James White, Wiltshire (GB); Tom Vallance Hamilton Crawford, Wiltshire (GB)

(73) Assignee: Dyson Technology Limited, Malmesbury (GB)

( * ) Notice: Subject to any disclaimer, the term of this patent is extended or adjusted under 35 U.S.C. 154(b) by 582 days.

(21) Appl. No.: 12/184,858

(22) Filed: Aug. 1, 2008

(65) Prior Publication Data

US 2009/0038111 A1 Feb. 12, 2009

(30) Foreign Application Priority Data

Aug. 9, 2007 (GB) ..... 0715563.3

(51) Int. Cl.
*A47L 9/00* (2006.01)

(52) U.S. Cl. ..... 15/410; 15/328; 15/334; 15/335

(58) Field of Classification Search ..... 15/329, 15/332, 334, 335, 410; *A47L 9/00*
See application file for complete search history.

(56) References Cited

U.S. PATENT DOCUMENTS

| | | | |
|---|---|---|---|
| 2,660,457 | A | 11/1953 | Mallon |
| 4,519,113 | A | 5/1985 | Hipple |
| 5,331,715 | A | 7/1994 | Johnson et al. |

FOREIGN PATENT DOCUMENTS

| | | |
|---|---|---|
| GB | 2329944 | 4/1999 |
| GB | 2 359 735 | 9/2001 |
| GB | 2359735 | 9/2001 |
| GB | 2 413 943 | 11/2005 |
| GB | 2 416 296 | 1/2006 |
| JP | 2005-143724 | 6/2005 |
| WO | WO-01/65989 | 9/2001 |
| WO | WO-03/101273 | 12/2003 |
| WO | WO-2005/079648 | 9/2005 |
| WO | WO-2005/110178 | 11/2005 |
| WO | WO-2006/008444 | 1/2006 |

OTHER PUBLICATIONS

GB Search Report mailed Oct. 19, 2007, directed to counterpart GB application No. 0715563.3; 1 page.
International Search Report and Written Opinion mailed on Nov. 14, 2008 directed at counterpart application No. PCT/GB2008/002509; 13 pages.

*Primary Examiner* — David Redding
(74) *Attorney, Agent, or Firm* — Morrison & Foerster LLP

(57) ABSTRACT

A cleaning appliance includes a main body, a handle assembly and a hose. The handle assembly includes a tube and a gripping portion fixedly attached thereto. The hose has one end attached to the main body. The tube is movable relative to the main body between a stored position in which at least a part of the tube lies within the hose and an extended position in which the gripping portion can be used to manipulate the cleaning appliance in use. By providing such an arrangement, the handle assembly and the hose can be stored compactly. When the user wishes to store the cleaning appliance, the tube can be retracted inside the hose for storage. When the tube is extended, the gripping portion is at a convenient height to be manipulated by a user.

13 Claims, 5 Drawing Sheets

CLEANING APPLIANCE

REFERENCE TO RELATED APPLICATIONS

This application claims the priority of United Kingdom Application No. 0715563.3, filed Aug. 9, 2007, the contents which are incorporated herein by reference.

FIELD OF THE INVENTION

The present invention relates to a cleaning appliance. Particularly, but not exclusively, the present invention relates to a vacuum cleaner.

BACKGROUND OF THE INVENTION

Upright vacuum cleaners are well known. Further, upright vacuum cleaners that can be converted from a floor cleaning mode into an "above-the-floor" cleaning mode are also well known. In order to carry out both of these cleaning modes, it is common for an upright vacuum cleaner to incorporate a handle assembly which can be used when required for above-the-floor cleaning. A known arrangement is shown in U.S. Pat. No. 4,519,113. In this arrangement, the handle assembly includes a handle and a wand which are attached to the cleaner head such that they form part of the airflow path within the vacuum cleaner when the machine is used in the floor cleaning mode. The handle and a wand are releasable from the cleaner head when above-the-floor cleaning is required. Whilst this arrangement is simple to implement, the air has to travel through the wand and hose when the machine is used in the floor cleaning mode. This increases losses within the vacuum cleaner. Further, when the machine is used in the floor cleaning mode, the hose hangs behind the handle and wand. This is cumbersome and frustrating for a user, and requires extra storage space.

Another known type of handle assembly forming part of a vacuum cleaner is shown in EP 1 265 519. In this arrangement, a handle and wand are releasably attached to a main body of the vacuum cleaner by a catch. A hose is stored around a part of the wand. The handle and wand can be released from the upper end of the hose, turned around and reconnected. In this way, when the handle assembly is to be used for above-the-floor cleaning, the hose is attached to the handle portion with the wand then projecting away from the hose. This arrangement includes a changeover valve which selectively directs incoming air either through the cleaner head or through the hose. Therefore, when the vacuum cleaner is used for above-the-floor cleaning, no air is drawn through the cleaner head.

A further variation of handle assembly is shown in WO 2006/008444. In this arrangement, the illustrated vacuum cleaner has a handle assembly comprising a hose and a tubular wand which is slideable between a stowed and an extended position with respect to a handle of the vacuum cleaner. The handle assembly is releasable from the remainder of the vacuum cleaner. When attached to the vacuum cleaner, the handle is fixed with respect to the main body.

It is also known to provide an extendible handle on a vacuum cleaner in order to reduce the size of the vacuum cleaner when stored. Such an arrangement is shown in U.S. Pat. No. 2,660,457. In this arrangement, a wand forms part of a handle assembly of the vacuum cleaner shown therein. The wand is extendible to provide a handle which can be gripped by a user. The wand can also be removed from the remainder of the vacuum cleaner and reattached to a hose located at the front of the vacuum cleaner for above-the-floor cleaning purposes. However, this arrangement requires separate storage of a hose, which is inconvenient for a user and adds to the overall size of the appliance.

SUMMARY OF THE INVENTION

It is an object of the invention to provide an improved handle assembly for a vacuum cleaner which improves upon the prior art arrangements. It is a further object of the invention to provide an improved handle assembly for a vacuum cleaner which is more compact and easier to store than prior art arrangements.

According to the invention, there is provided a cleaning appliance comprising a main body, a handle assembly and a hose, the handle assembly comprising a tube and a gripping portion fixedly attached thereto and the hose having one end attached to the main body, wherein the tube is movable relative to the main body between a stored position in which at least a part of the tube lies within the hose and an extended position in which the gripping portion can be used to manipulate the cleaning appliance in use.

By providing such an arrangement, the handle assembly and the hose can be stored in a compact manner. When the user wishes to store the cleaning appliance, the tube can be retracted inside the hose for storage. However, when the tube is extended, the gripping portion is at a convenient height to be manipulated by a user. This arrangement requires less space than conventional arrangements.

Preferably, the handle assembly is removable from the main body. More preferably, the handle assembly further comprises a connecting portion which is adapted and arranged to connect releasably to the main body, the tube being slideably movable with respect to the connecting portion. By providing such an arrangement, the handle assembly can be releasably attached to the main body in order to be used to manipulate the vacuum cleaner in use, but can also be detached in order to enable above-the-floor cleaning to be carried out.

Preferably, wherein the handle assembly further comprises a further tube connected to the connecting portion, the tube being telescopically slideable within the further tube. More preferably, at least a part of the further tube lies within the hose when the handle assembly is releasably connected to the main body.

By providing such an arrangement, the tube and further tube can be extended to form a longer wand so that areas above the floor such as ceilings or doors can be cleaned easily.

However, the tube and further tube can be retracted inside one another for convenient storage, or to enable cleaning of areas which are not suited to a larger wand.

Preferably, the gripping portion extends away from the tube and forms a part of a handle. By providing such an arrangement, the handle can be conveniently gripped by a user when the vacuum cleaner is used for floor cleaning or above-the-floor cleaning.

BRIEF DESCRIPTION OF THE DRAWINGS

An embodiment of the invention will now be described with reference to the accompanying drawings, in which.

DETAILED DESCRIPTION OF THE INVENTION

Figure 1:
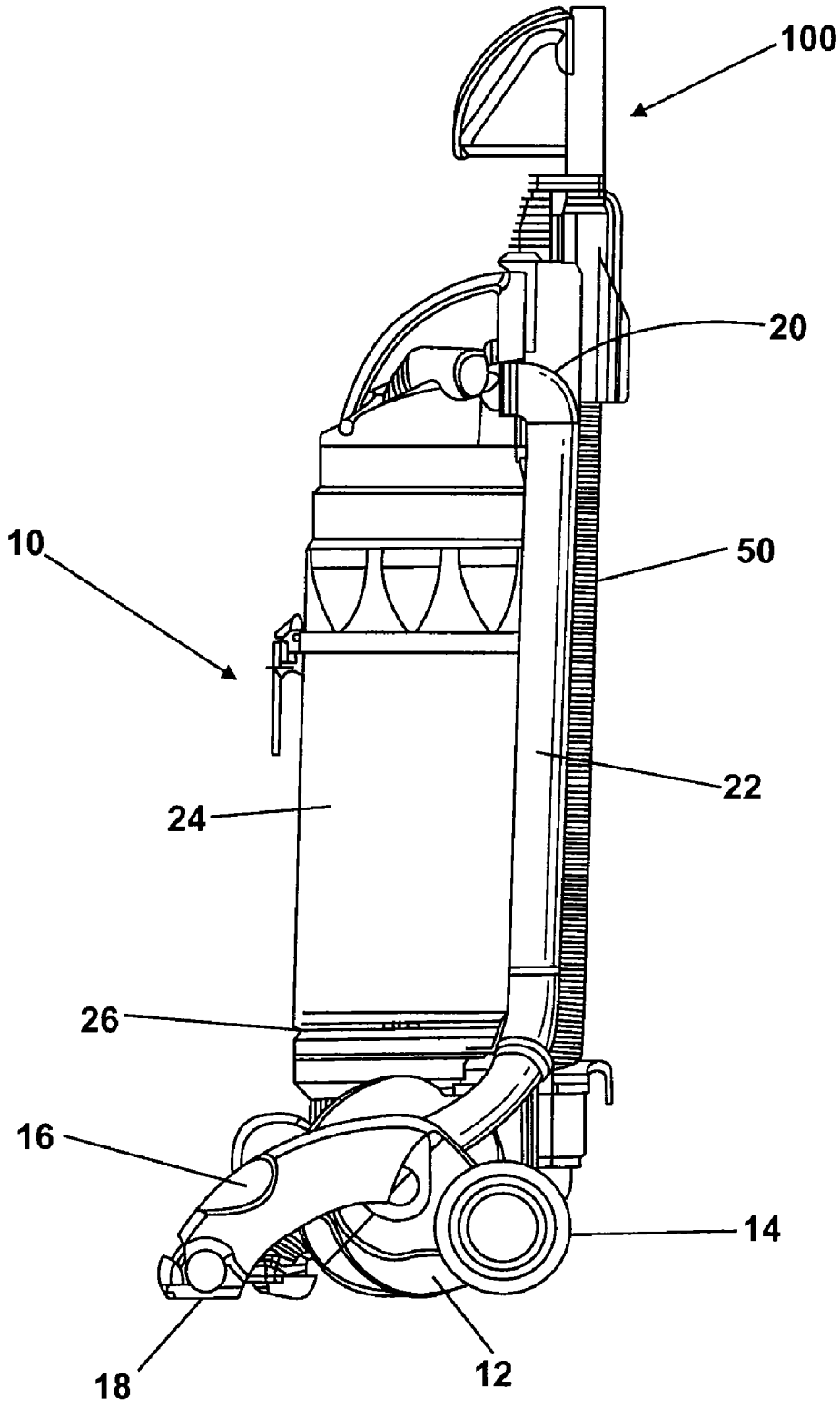
FIG. 1 is a side view of a cleaning appliance according to the invention in the form of an upright vacuum cleaner incorporating a handle assembly which is shown in a stored configuration.

A cleaning appliance according to the invention in the form of a vacuum cleaner is shown in FIG. 1. FIG. 1 shows an upright vacuum cleaner 10 having a main body 12 which includes a motor and fan unit (not shown) and a pair of wheels 14. A cleaner head 16 is pivotably mounted on the lower end of the main body 12 and a dirty air inlet 18 is provided in the underside of the cleaner head 16 facing the floor surface. The main body 12 further includes a spine 20 which extends upwards and includes ducting 22 for carrying an airflow.

Separating apparatus 24 is releasably held on the main body 12 adjacent the spine 20. In the embodiment shown, the separating apparatus 24 comprises a cyclonic separator but this could be replaced by a filter, a bag or a combination of different known separation devices. The nature of the separating apparatus 24 is not material to the present invention.

The interior of the separating apparatus 24 is in communication with the dirty air inlet 18 through the ducting 22 in the spine 20. Further, the separating apparatus 24 can be removed from the main body 12 for emptying purposes. The main body 12 also includes a plurality of outlet ports 26 for exhausting air from the vacuum cleaner 10. The outlet ports 26 are located below the separating apparatus 24. These features are not material to the present invention and will not be discussed further.

The vacuum cleaner 10 includes a hose 50 and a handle assembly 100. When attached to the vacuum cleaner 10 as shown in FIG. 1, a part of the handle assembly 100 extends inside the hose 50. The handle assembly 100 can be detached from the vacuum cleaner 10 and arranged so as to enable above-the-floor cleaning. These features will be discussed further later. The handle assembly 100 is shown in a stored configuration in FIG. 1. When the handle assembly 100 is in the stored configuration, the vacuum cleaner 10 is compact and easy to store.

Figure 2:
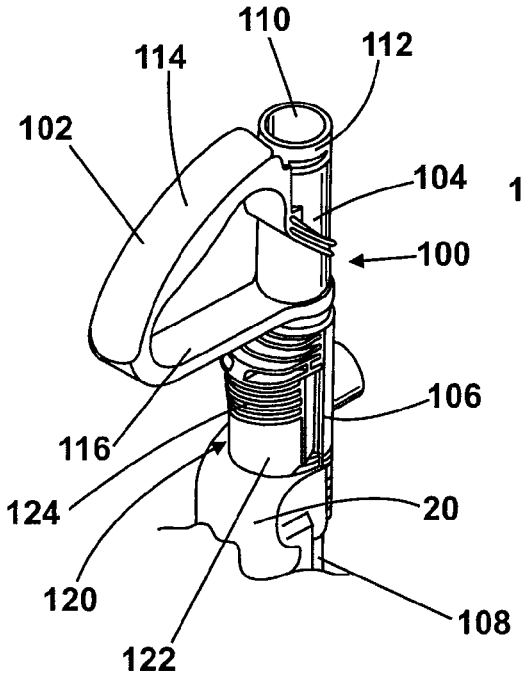
FIG. 2 is an isometric view of the handle assembly showing the handle assembly in the stored configuration and attached to a part of the upright vacuum cleaner of FIG. 1.
Figure 3:
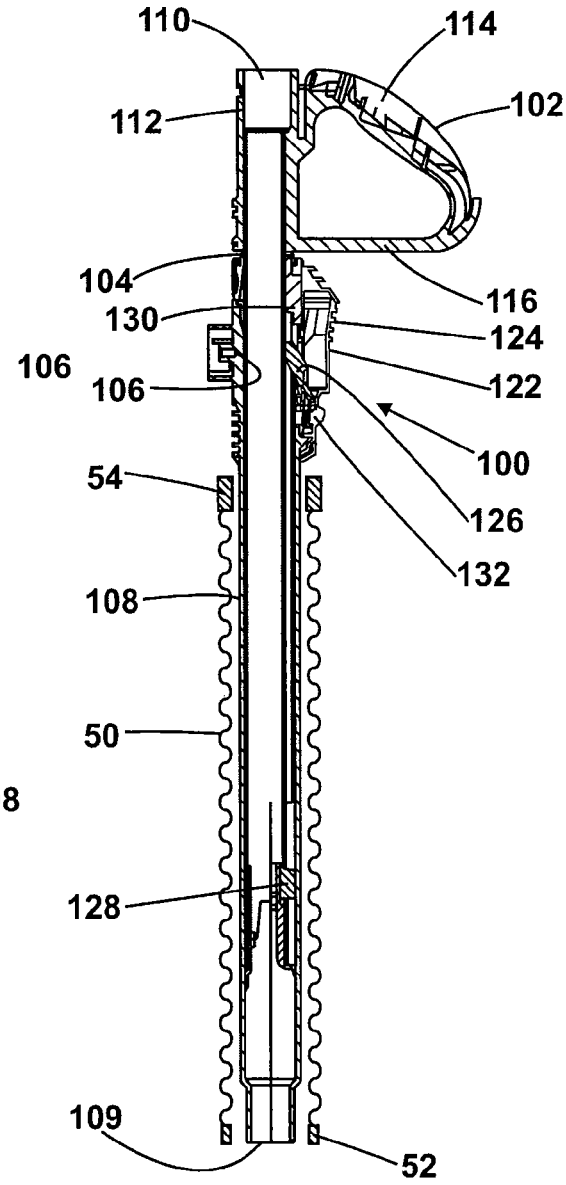
FIG. 3 is a side section of the handle assembly of FIG. 2 showing the handle assembly in the stored configuration.

The handle assembly 100 is shown in more detail in FIGS. 2 and 3. For clarity, FIG. 2 shows only the upper end of the handle assembly 100 and a part of the spine 20 of the vacuum cleaner 10. FIG. 3 shows the complete handle assembly 100 and hose 50 removed from the remainder of the vacuum cleaner 10. The handle assembly 100 is shown in the stored configuration in FIGS. 2 and 3.

The handle assembly 100 comprises a handle 102, a tubular wand 104, a connecting portion 106 and a fixed tube 108. The connecting portion 106 is adapted to connect to the spine 20 of the vacuum cleaner 10. The fixed tube 108 is attached to the connecting portion 106 and extends downwards from the connecting portion 106. The fixed tube 108 is hollow inside and has an opening 109 at the lower end.

Figure 4:
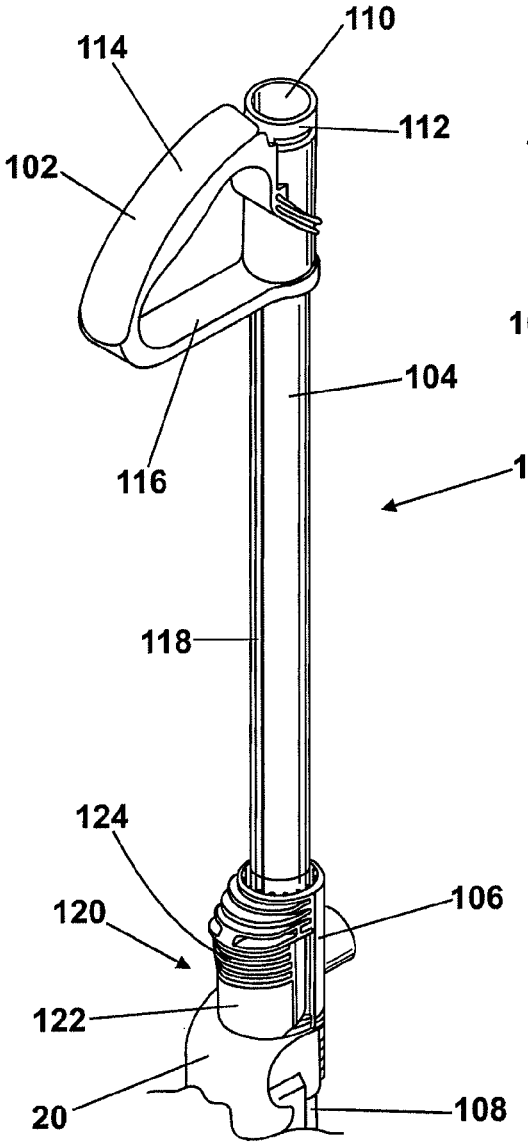
FIG. 4 is an isometric view of the handle assembly of FIG. 2 showing the handle assembly in an extended configuration.
Figure 5A:
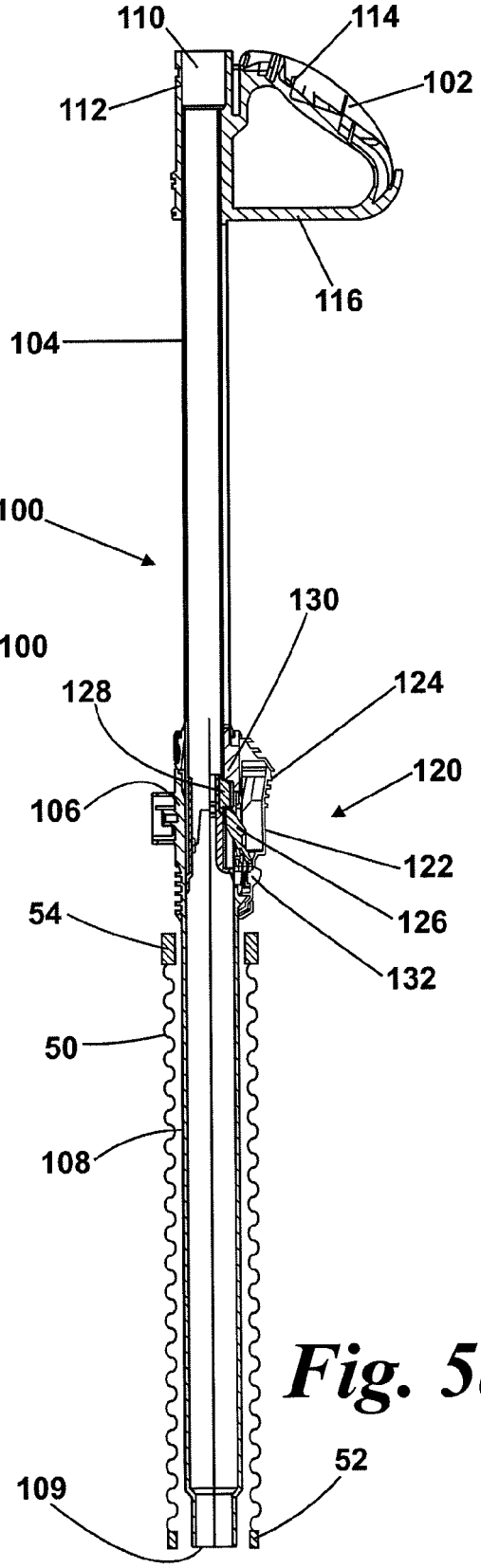
FIG. 5*a* is a side section of the handle assembly of FIG. 2 showing the handle assembly in the extended configuration.
Figure 5B:
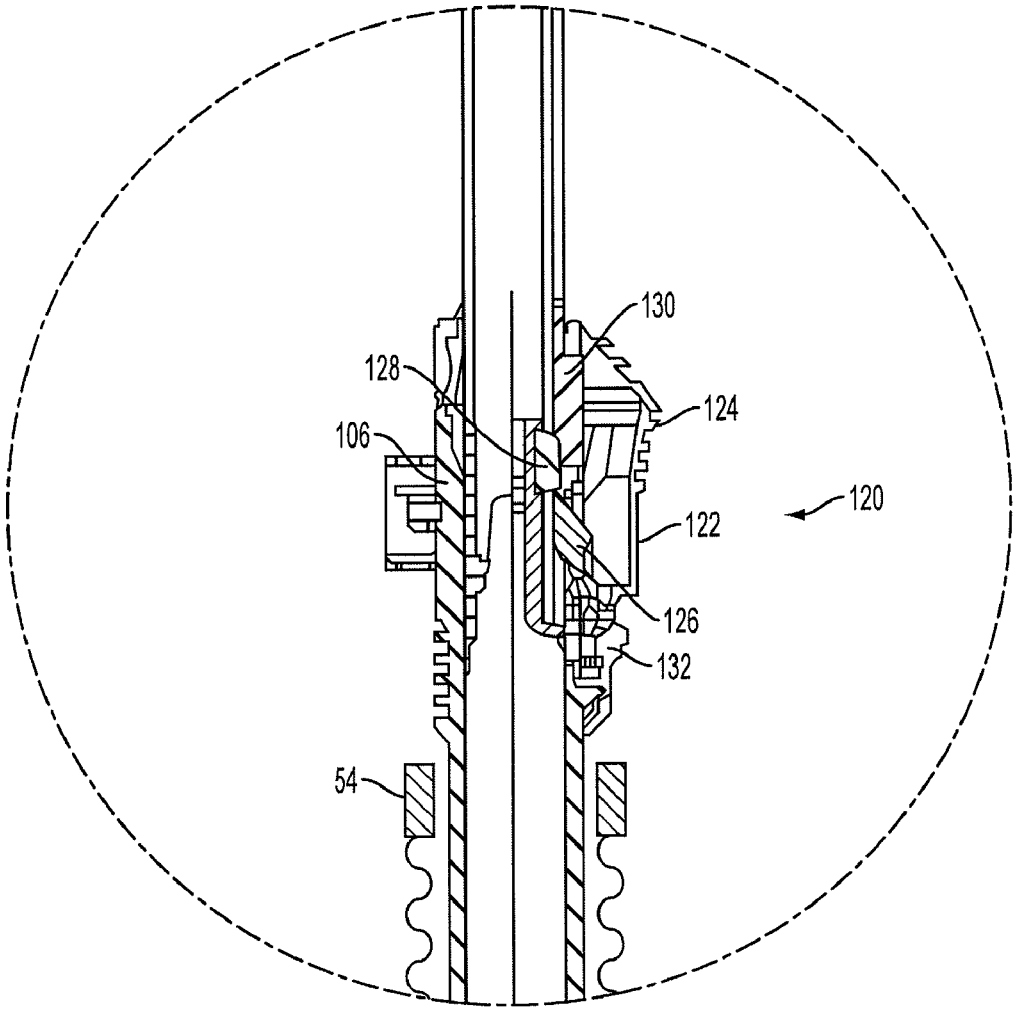
FIG. 5*b* is an exploded view of the locking mechanism of FIG. 5*a*.

The tubular wand 104 is able to slide with respect to the connecting portion 106 between a retracted position (as shown in FIGS. 2 and 3) and an extended position (as shown in FIGS. 4 and 5). Therefore, when the handle assembly 100 is attached to the main body 12 of the vacuum cleaner 10, the tubular wand 104 is able to slide with respect to the main body 12. The tubular wand 104 has a diameter which is smaller than that of the fixed tube 108 so that, when the tubular wand 104 is in the retracted position, a significant portion of the tubular wand 104 can be stored within the fixed tube 108. This is shown in FIG. 3. The tubular wand 104 and the fixed tube 108 lie coaxially with respect to one another, such that the tubular wand 104 is able to slide within the fixed tube 108.

The tubular wand 104 is hollow inside and is open at its upper end 110. The open upper end 110 forms a connector 112 which is adapted to receive an end of the hose 50 when above-the-floor cleaning is required. A cover (not shown) may be provided over the upper end 110 to prevent ingress of dirt and dust into the tubular wand 104 and also to improve the appearance of the handle assembly 100.

The handle 102 is fixedly attached to the upper end 110 of the tubular wand 104 and moves with respect to the connecting portion 106 when the tubular wand 104 is slid between the retracted and extended positions. The handle 102 has a gripping portion 114 and a support member 116. The gripping portion 114 extends away from the tubular wand 104 and is arranged to be gripped by a user when maneuvering the vacuum cleaner 10 across a floor surface or during above-the-floor cleaning. The support member 116 provides mechanical support for the gripping portion 114.

The hose 50 is secured to the main body 12 of the vacuum cleaner by a first connector 52 located at a first end of the hose 50. The first connector 52 is releasable so that the hose 50 can be removed for cleaning or replacement. However, other arrangements could be used; for example, a permanent connection to the main body 12 of the vacuum cleaner 10. The hose 50 also has a second connector 54 located at a second end of the hose 50. The second connector 54 is arranged to connect to the connector 112 when above-the-floor cleaning takes place.

Further, when the handle assembly 100 is stored on the vacuum cleaner 10, substantial portions of the tubular wand 104 and the fixed tube 108 lie inside the hose 50. This is shown in FIG. 3. The hose 50 sits around the outside of the fixed tube 108 but does not seal against it. By storing the tubular wand 104, the fixed tube 108 and the hose 50 coaxially with respect to one another, the handle assembly 100 is compact and easy to store.

In the configuration shown in FIGS. 1 and 2, no airflow is carried by the hose 50. This is because the vacuum cleaner 10 has a change-over valve (not shown) which selectively draws air in through the dirty air inlet 18 on the cleaner head 16 or through the hose 50. The change-over valve is operated by the lower end of the fixed tube 108. When the handle assembly 100 is stored on the vacuum cleaner 10 in the configuration shown in FIGS. 1 and 2, the fixed tube 108 engages with a part of the change-over valve in order to move the change-over valve into a position in which air is drawn in through the dirty air inlet 18.

When the tubular wand 104 is in the retracted position (as shown in FIGS. 2 and 3), the handle 102 lies directly above the connecting portion 106 and the tubular wand 104 is stored within the fixed tube 108. In this configuration, the vacuum cleaner 10 is compact and easy to store. However, in order for the user to use comfortably the vacuum cleaner 10 to clean a floor surface, the handle assembly 100 needs to be moved to an extended configuration.

The handle assembly 100 is shown in the extended configuration in FIGS. 4 and 5. FIG. 4 shows only the upper end of the handle assembly 100 and a part of the spine 20 of the vacuum cleaner 10. FIG. 5 shows the complete handle assembly 100 and hose 50 removed from the remainder of the vacuum cleaner 10 for clarity. In the extended configuration, the tubular wand 104 extends upwardly away from the connecting portion 106. In this configuration, the handle 102 is at a convenient height to be gripped by a standing user. Therefore, the vacuum cleaner 10 can be manoeuvred easily across a floor surface using the handle 102.

In order to facilitate the extension and retraction of the tubular wand 104 between the positions shown in FIGS. 3 and 5, the tubular wand 104 has a longitudinal groove 118 (this is best shown in FIG. 4) which cooperates with a complementary lug (not shown) located on the connecting portion 106. The longitudinal groove 118 and lug guide the tubular wand 104 along a linear path between the retracted and extended positions with respect to the connecting portion 106. Further, the longitudinal groove 118 and lug prevent the tubular wand 104 from rotating about the axis of movement with respect to the connecting portion 106.

The connecting portion 106 further includes a locking mechanism 120. The locking mechanism 120 is arranged to secure the handle assembly 100 to the spine 20 of the vacuum cleaner 10 as shown in FIGS. 1, 2 and 4. The locking mechanism 120 is also arranged to lock the tubular wand 104 in the extended position (as shown in FIGS. 4 and 5).

The locking mechanism 120 includes an actuator 122 which is pivotably mounted on the connecting portion 106. The actuator 122 is arranged to be pressed by a user to release the handle assembly 100 from the spine 20 and to unlock the tubular wand 104. The actuator 122 is pivotably located on a part of the connecting portion 106 which faces forwardly away from the user when the handle assembly 100 is connected to the vacuum cleaner 10. The makes the actuator 122 easily graspable by a user. The upper end of the actuator 122 has a plurality of parallel ribs 124 which define a user-operable button.

The locking mechanism 120 also includes a first locking arrangement comprising a wand catch 126, a lug 128 and a shoulder 130. The wand catch 126 (FIGS. 3 and 5) is pivotably connected to the connecting portion 106. The wand catch 126 engages with the lug 128 to prevent the tubular wand 104 from moving downwardly. The tubular wand 104 is also prevented from moving upwardly by the shoulder 130 located towards the upper end of the connecting portion 106. When the wand catch 126 is engaged with the tubular wand 104, the tubular wand 104 is prevented from sliding with respect to the connecting portion 106 due to the interaction between the lug 128, the wand catch 126 and the shoulder 130. The engagement between these parts locks the tubular wand 104 in the extended position as shown in FIG. 5.

When pressed, the actuator 122 engages with the wand catch 126 and pivots the wand catch 126 away from the tubular wand 104 to release the wand catch 126 from its engagement with a lug 132.

The locking mechanism 120 also includes a second locking arrangement comprising a main body catch 132. The main body catch 132 is adapted to engage with a part (not shown) of the main body 12 of the vacuum cleaner 10 in order to secure the handle assembly 100 to the main body 12. The main body catch 132 is also releasable by pressing the actuator 122.

The arrangement described above is particularly suited to a small upright vacuum cleaner, commonly known as a stick-vacuum. Stick-vacuums are generally much smaller in size than conventional upright vacuum cleaners. Therefore, they tend to be less powerful and comprise fewer features. However, the above arrangement allows the handle assembly and the hose to be compact when stored yet to have excellent functionality.

Figure 6:
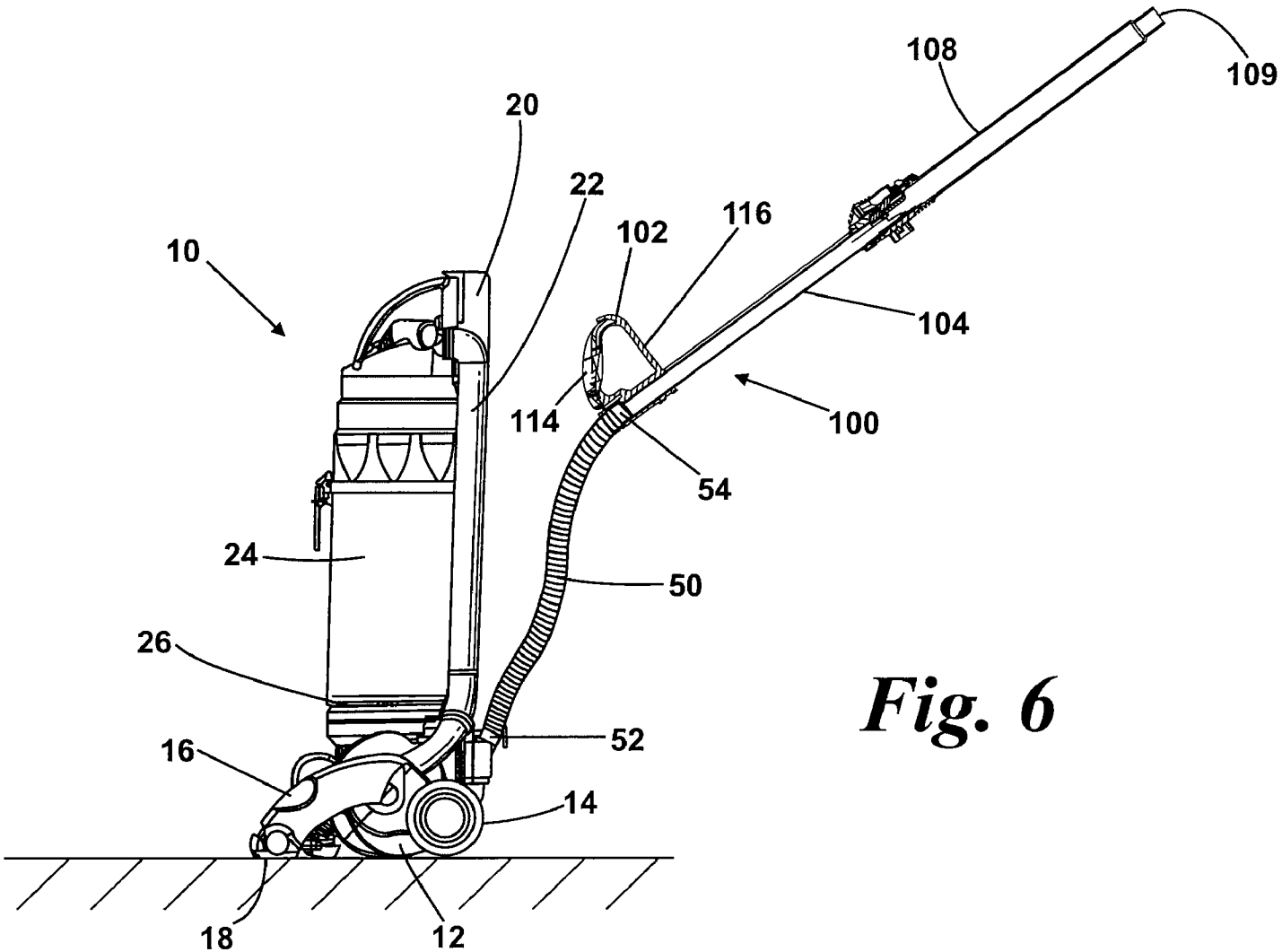
FIG. 6 is a side view of the vacuum cleaner of FIG. 1 showing the handle assembly released from the vacuum cleaner and configured for above-the-floor cleaning.

In use, the user starts with the vacuum cleaner 10 in the configuration shown in FIG. 1. In this configuration, the handle assembly 100 is in the stored configuration; the handle assembly 100 is secured to the main body 12 of the vacuum cleaner 10 and the tubular wand 104 is in the retracted position. In this position, a part of the tubular wand lies within the hose 50. In order to configure the vacuum cleaner 10 for cleaning a floor surface, the user extends the tubular wand 104 by pulling upwardly on the handle 102 until the tubular wand 104 is locked in the extended position shown in FIG. 4. The locking mechanism 120 is now in the first configuration as shown in FIG. 6.

The user then switches the vacuum cleaner 10 on so that the motor and fan unit draws dirty air into the vacuum cleaner 10 via the dirty air inlet 18. The user manipulates the handle 102 to manoeuvre the vacuum cleaner 10 across the floor surface in order to carry out a cleaning operation. The dirty air, carrying dirt and dust from the floor surface, is drawn into the separating apparatus 24 via the ducting 22 in the spine 20. Dirt and dust is separated from the airflow by the separating apparatus 24 and retained therein. The cleaned air then passes from the separating apparatus 24, through a pre-motor filter (not shown), across the motor for cooling and through a post-motor filter (not shown) before being ejected from the vacuum cleaner 10 via the outlet ports 26.

The user may also wish to clean surfaces above the floor. In order to do this the user depresses the actuator 122. This moves the locking mechanism 120 to unlock the main body catch 132 and release the connecting portion 106 from the spine 20. The handle assembly 100 can then be removed from the main body 12 of the vacuum cleaner 10. As the user removes the handle assembly 100 from the main body 12, the fixed tube 108 will slide out of the hose 50. When the fixed tube 108 is removed from the stored position shown in FIGS. 2 and 3, the change-over valve switches the airflow path to draw air in through the hose 50 instead of the dirty air inlet 18.

Once the handle assembly 100 is released from the main body 12 of the vacuum cleaner 10 and the hose 50, the user turns the handle assembly 100 around and attaches the second connector 54 of the hose 50 to the connector 116 adjacent the handle 102. The second connector 54 attaches to the connector 116 by way of a catch (not shown) although other arrangements, such as a friction fit or a snap fit, may alternatively be used. The vacuum cleaner 10 is now configured for above-the-floor cleaning. This configuration is shown in FIG. 6. The user then grips the gripping portion 114 of the handle 102 and manipulates the handle assembly 100 to clean, for example, walls, doors or ceilings. Optionally, an accessory tool such as a stair tool or a crevice tool may be attached to the distal end of the fixed pipe 108.

When the user has finished the above-the-floor cleaning operation, the user may wish to return the vacuum cleaner 10 to the floor cleaning mode. In order to do this, the user disconnects the second connector 54 from the connector 116, turns the handle assembly 100 around and re-inserts the fixed tube 108 back into the end of the hose 50. The user also aligns the connecting portion 106 with the spine 20 of the vacuum cleaner 10 in order to reattach the handle assembly 100 to the main body 12 of the vacuum cleaner 10.

The handle assembly 100 is now releasably secured to the main body 12 of the vacuum cleaner 10 by engagement of the main body catch 132 with a part of the main body 12 of the vacuum cleaner. The tubular wand 104 also remains locked in the extended position by engagement between the wand catch 126, the lug 128 and the shoulder 130. The replacement of the handle assembly 100 on the vacuum cleaner 10 operates the change-over valve which switches the airflow path back to draw air in through the dirty air inlet 18. The vacuum cleaner 10 is now re-configured for floor cleaning without the user having to be concerned about returning the tubular wand 104 to the extended position. The tubular wand 104 is also prevented from collapsing unexpectedly which may cause injury or be frustrating.

When the user has finished the cleaning operation, the vacuum cleaner 10 is switched off. In order to return the vacuum cleaner 10 to a storage configuration as shown in FIG. 1, the user depresses the actuator 122. This action unlocks the wand catch 126 from the tubular wand 104 and allows the tubular wand 104 to be collapsed from the extended position into the retracted position for storage. The geometry of the connecting portion 106 ensures that the handle assembly 100 will not fall away from the vacuum cleaner 10 during this process unless the user desires to remove the handle assembly 100. The vacuum cleaner 10 is now back in the configuration shown in FIG. 1.

The invention is not limited to the detailed description given above. Variations will be apparent to the person skilled in the art. For example, there also need not be a fixed tube. Instead, a single tube or tubular wand may be provided.

Additionally, the whole of the tube or tubular wand may lie within the hose when stored. Further, the whole of the fixed tube may also lie within the hose.

The handle assembly need not be releasable from the main body of the vacuum cleaner. What is important is that the tube or tubular wand moves with respect to the main body so that, when stored, at least a part of the tube or tubular wand lies within the hose. For example, the tube or tubular wand could be extended in order to access the hose, and retracted into the hose for storage.

The handle need not extend from the tubular wand. Instead, a contoured or textured gripping portion may be provided on the surface of the tubular wand to enable the tubular wand to be manipulated comfortably by a user.

Additionally, the tubular wand may have more positions than merely retracted and extended. Notches may be provided in the longitudinal groove to allow the wand to be locked in a number of different positions of extension.

Further, other forms and arrangements of the wand catch and main body catch may be used; for instance, electronic or magnetic catches. If mechanical catches are used, arrangements other than pivotable catches may be used; for example, sliding or deformable catches.

Alternative forms of actuator may be used. The actuator need not be pivotable nor need it comprise a user operable button. The actuator may be electronically operated or may comprise sliding or deformable components.

The cleaning appliance need not be an upright vacuum cleaner. The invention is applicable to other types of vacuum cleaner, for example, stick-vacuums. Further, the present invention is applicable to other types of cleaning appliances, for example, a wet and dry machine or a carpet shampooer.

The invention claimed is:

1. A cleaning appliance comprising:
a main body;
a handle assembly; and
a hose,
wherein the handle assembly comprises a tube and a gripping portion,
wherein the gripping portion is fixedly attached to the tube,
wherein one end of the hose is attached to the main body, and
wherein the handle assembly is configured to be movable relative to the main body between a stored position in which at least a part of the tube lies within the hose and an extended position in which the gripping portion can be used to manipulate the cleaning appliance in use.

2. The cleaning appliance of claim 1, wherein the handle assembly is configured to be removable from the main body.

3. The cleaning appliance of claim 2, wherein the handle assembly further comprises a connecting portion which is configured to connect releasably to the main body, the tube being slideably movable with respect to the connecting portion.

4. The cleaning appliance of claim 3, wherein the connecting portion includes a first locking arrangement releasably securing the handle assembly to the main body.

5. The cleaning appliance of claim 4, wherein the connecting portion further includes a second locking arrangement releasably locking the tube in the extended position.

6. The cleaning appliance of claims 3 to 5, wherein the handle assembly further comprises a further tube connected to the connecting portion, the tube being configured to slide telescopically within the further tube.

7. The cleaning appliance of claim 6, wherein at least a part of the further tube lies within the hose when the handle assembly is releasably connected to the main body.

8. The cleaning appliance of claim 1, 2, 3 or 4, wherein the tube is hollow and has a first opening located adjacent the gripping portion which is adapted to connect to the hose.

9. The cleaning appliance of claim 6, wherein the further tube is hollow and has a second opening in fluid communication with the first opening.

10. The cleaning appliance of claim 9, wherein the second opening is configured to receive an accessory tool or floor tool.

11. The cleaning appliance of claim 1, 2, 3 or 4, wherein the gripping portion extends away from the tube and forms a part of a handle.

12. The cleaning appliance of claim 1, 2, 3 or 4, wherein the cleaning appliance is a vacuum cleaner.

13. The cleaning appliance of claim 12, wherein the vacuum cleaner is an upright vacuum cleaner.

* * * * *